United States Patent [19]

Dekker et al.

[11] Patent Number: 4,848,417

[45] Date of Patent: Jul. 18, 1989

[54] MONITOR DEVICE FOR A WEFT YARN STORE AND A METHOD OF OPERATING A WEFT YARN STORE

[76] Inventors: Martinus Dekker, Beukenstraat 14 NL-5753 GB; Hubertus Achten, Weerijs 52 NL-5751 VW; Lodewijk Heinemans, Niers 21, NL-5751 TR, all of, Deurne, Netherlands

[21] Appl. No.: 176,941

[22] Filed: Apr. 4, 1988

[30] Foreign Application Priority Data

Apr. 8, 1987 [CH] Switzerland ..... 01349/87

[51] Int. Cl.[4] ..... D03D 47/36

[52] U.S. Cl. ..... 139/452; 139/370.2

[58] Field of Search ..... 139/452, 370.1, 370.2, 139/336 R; 242/47.01

[56] References Cited

U.S. PATENT DOCUMENTS

| | | | |
|---|---|---|---|
| 4,546,263 | 10/1985 | Gotoh et al. | 139/370.2 |
| 4,573,499 | 3/1986 | Sugita et al. | 139/370.2 |
| 4,614,311 | 9/1986 | Kakinaka | 139/452 |
| 4,617,971 | 10/1986 | Hellstroem | 139/452 |

*Primary Examiner*—Henry S. Jaudon

*Attorney, Agent, or Firm*—Kenyon & Kenyon

[57] ABSTRACT

The weft yarn leaving a drum of a weft yarn store of a loom is monitored by a monitor device having at least two pairs of transmitters and receivers in a monitor ring which output signals to an evaluating unit (W) independently of one another in accordance with the number of yarn windings drawn off the drum. The dual delivery of signals is evaluated in an evaluation unit so that interfering signals can be distinguished from genuine malfunctionings, such as yarn breakages, so that unnecessary interruptions in operation can be avoided.

12 Claims, 4 Drawing Sheets

A
B
W
S
SS
1
10
11
19
20
21
22
110
190
191
191'
192
192'
193
194
195

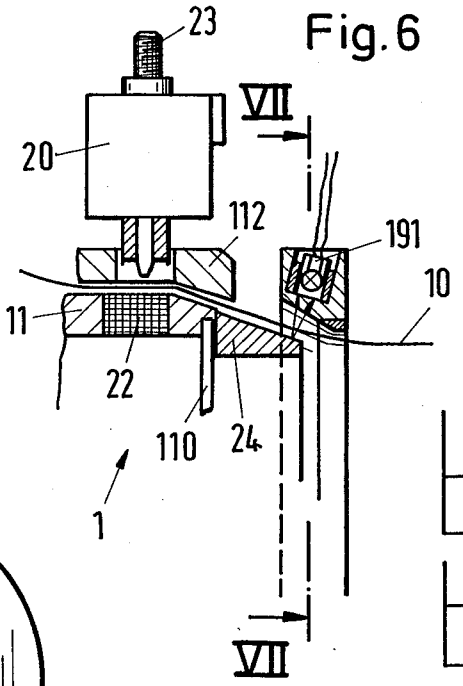
Fig. 6
23
20
VII
112
191
10
11
22
110
24
1
VII
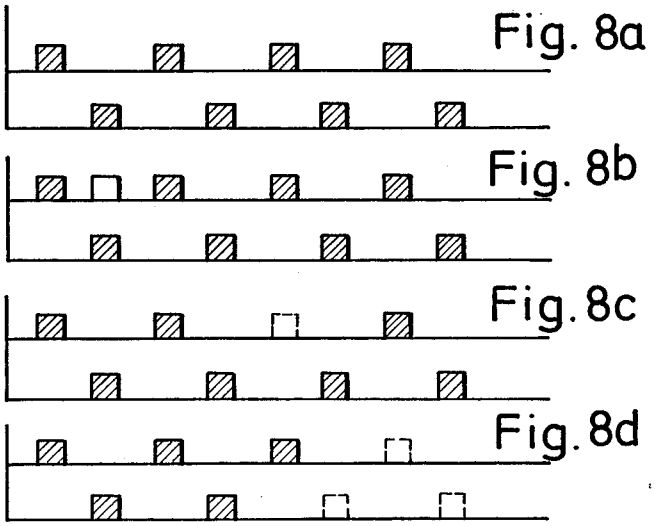
Fig. 8a
Fig. 8b
Fig. 8c
Fig. 8d
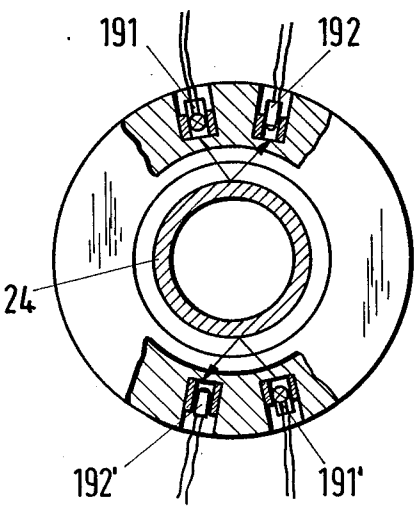
Fig. 7
192
191
24
191'
192'

MONITOR DEVICE FOR A WEFT YARN STORE AND A METHOD OF OPERATING A WEFT YARN STORE

This invention relates to a monitor device for a weft yarn store and a method of operating a weft yarn store.

Heretofore, various types of weft yarn stores have been known which employ monitoring devices for monitoring the operation of the stores. For example, Swiss Patent No. 647 999 discloses a yarn store for a loom comprising a stationary drum and a monitor device having two detectors for monitoring a yarn winding around the drum. In this construction, one detector is provided for a yarn to be wound onto the drum and at least one other detector is provided for the yarn to be drawn off the drum. After the second detector has reported back to a yarn store control a predetermined number of signals arising from the passage of the weft yarn, a stop device is activated to prevent further turns of yarn from being drawn off the yarn store drum. The accuracy of the length measurement of the weft yarn to be picked into the loom depends upon the operation of the second detector. However, should the second detector transmit too many or too few signals to the control in relation to the number of passages of weft yarn past the detector, the weft yarn in the loom becomes either too short or too long. In either case, these errors must be detected by a further detector on the catching side of the loom in order to be cleared by the loom operatives after the loom has been stopped. Interruptions of this kind in weaving as a result of malfunctionings of the monitoring or supervisory elements are unsatisfactory.

Accordingly, it is an object of the invention to provide a monitor device which detects and suppresses malfunctions related to internal operating circumstances.

It is another object of the invention to increase the reliability of a weft yarn monitor device.

Briefly, the invention provides a monitor device for a weft yarn store which includes at least two sensors, an evaluating unit and a yarn store control.

The sensors are mounted in circumferentially spaced relation about an opening of a yarn store with each sensor being operable to emit a signal in response to transverse passage of a Weft yarn thereby.

The evaluating unit is connected to each sensor to receive and evaluate a sequence of signals from each sensor and to emit a control signal in response to the sequences of signals conforming to a predetermined sequence of signals.

The yarn store control is connected to the evaluating unit to receive the control signal for controlling the weft yarn store in response thereto.

According to the invention, the signals of the monitor sensors are compared by the evaluating unit and are is taken into consideration for the control of the yarn store only when the sequence of the signals in time corresponds to an expectancy model. The absence of a single expected signal of a monitor sensor is taken into consideration only when the absence of a corresponding signal of at least one second sensor is also detected by the evaluating unit. Also, an excess unexpected signal from a sensor due, for example, to a speck of dirt in the sensitive zone of the sensor is not taken into consideration for the yarn store control if it occurs just once and is not detected by at least one second sensor. Disturbances relating to the monitor device, whether in the region of the sensors or in the device itself, can therefore be prevented from reacting on the control of the yarn store and loom.

The invention also provides a method of operating a yarn store for a loom. In this respect, a weft yarn is wound onto a drum of a yarn store into a plurality of windings and is taken off from one end of the drum in an axial direction. Thereafter, the passage of the yarn past at least two circumferentially spaced points at the end of the drum is sensed and a signal is emitted in response to passage past each point. The sequence of signals corresponding to each point is evaluated and a control signal is emitted in response to the sequences of signals conforming to a predetermined sequence of signals. This control signal is then used to control the weft yarn store.

These and other objects and advantages of the invention will become more apparent from the following detailed description taken in conjunction with the accompanying drawings wherein.

Figures 3, 4, 5A, 5B, 5C, 5D:
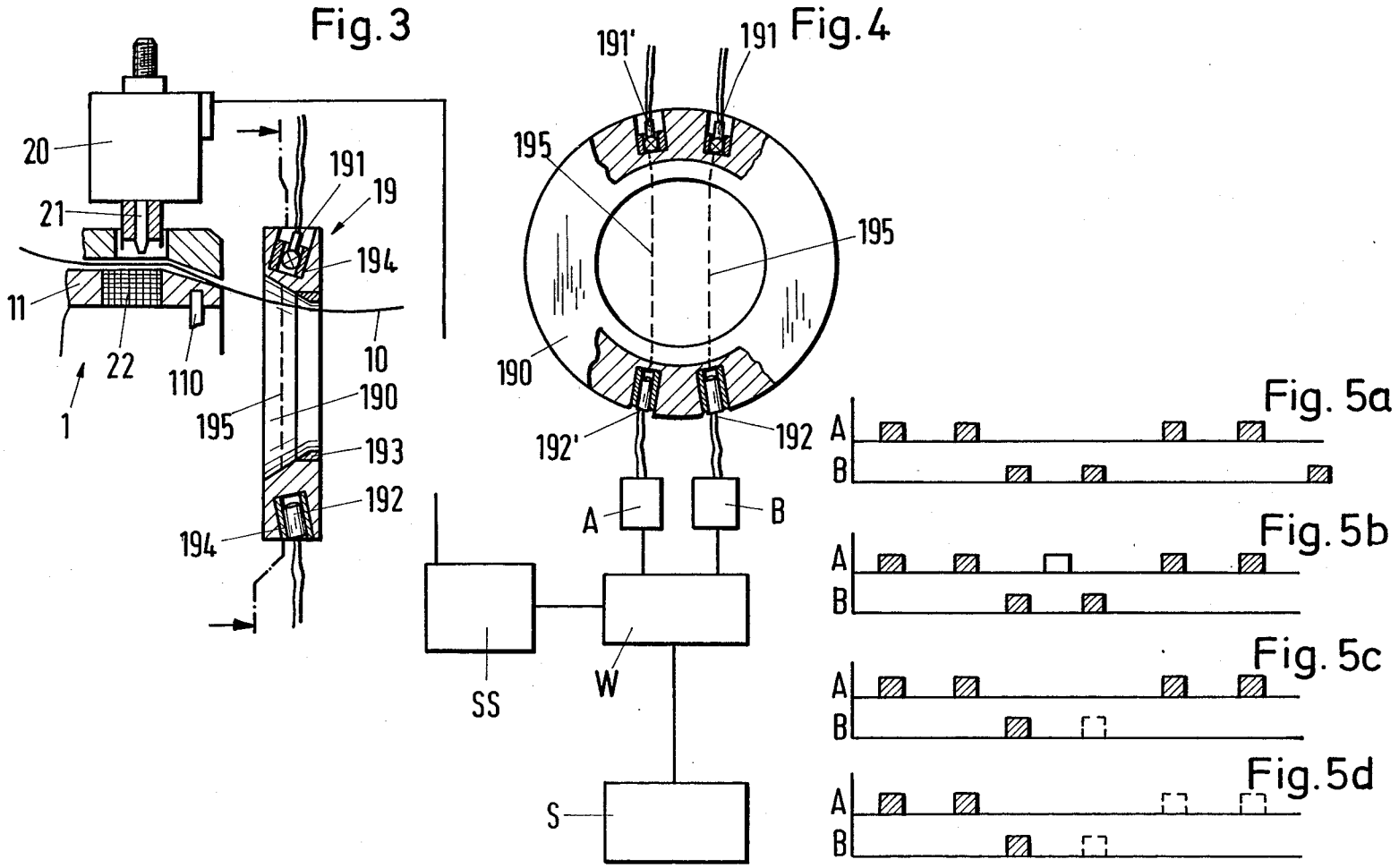
FIG. 3 illustrates a part cross-sectional view of a monitor device in accordance with the invention.
FIG. 4 illustrates an end view of the monitor device.

FIGS. 5*a*–5*d* graphically illustrate possible signal sequences from the sensors of the monitor device of FIG. 3;

FIG. 6 illustrates a part cross-sectional view of a modified monitor device according to the invention.

FIG. 7 illustrates an end view of the monitor device of FIG. 6, and

FIGS. 8*a*–8*d* graphically illustrate possible signal sequences of the monitor device of FIG. 7.

Figure 1:
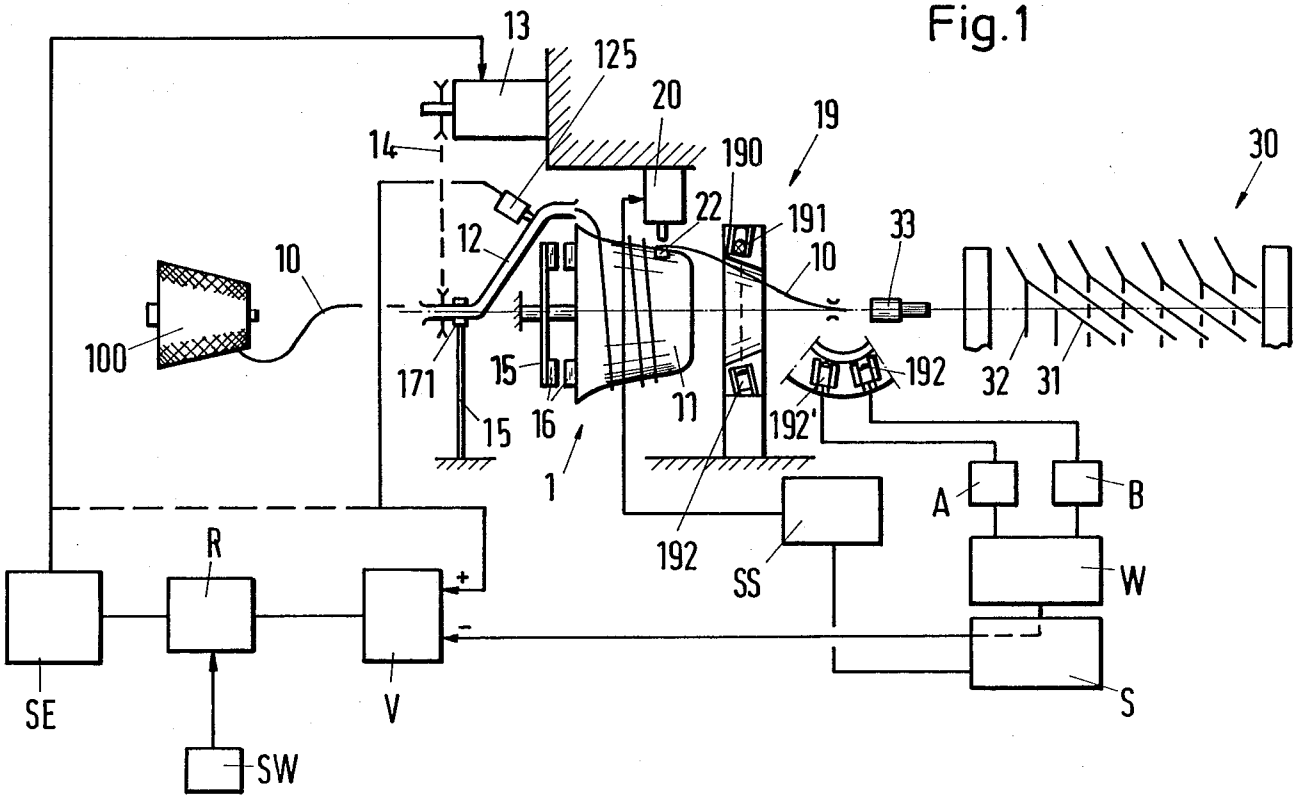
FIG. 1 illustrates a schematic overview of a weft yarn store for a loom according to the invention.

Referring to FIG. 1, a weft yarn 10 to be processed in a loom 30 is drawn off a yarn package 100 by a weft yarn store 1 and subsequently delivered to the loom 30. As indicated, the weft yarn store 1 includes a winder 12 for winding the weft yarn in a plurality of windings onto a stationary drum II. In addition, a control device 19 is provided along with an air jet nozzle 33 for picking the weft yarn 10 into a shed formed by warp yarns 31, 32 in the loom 30.

Figure 2:
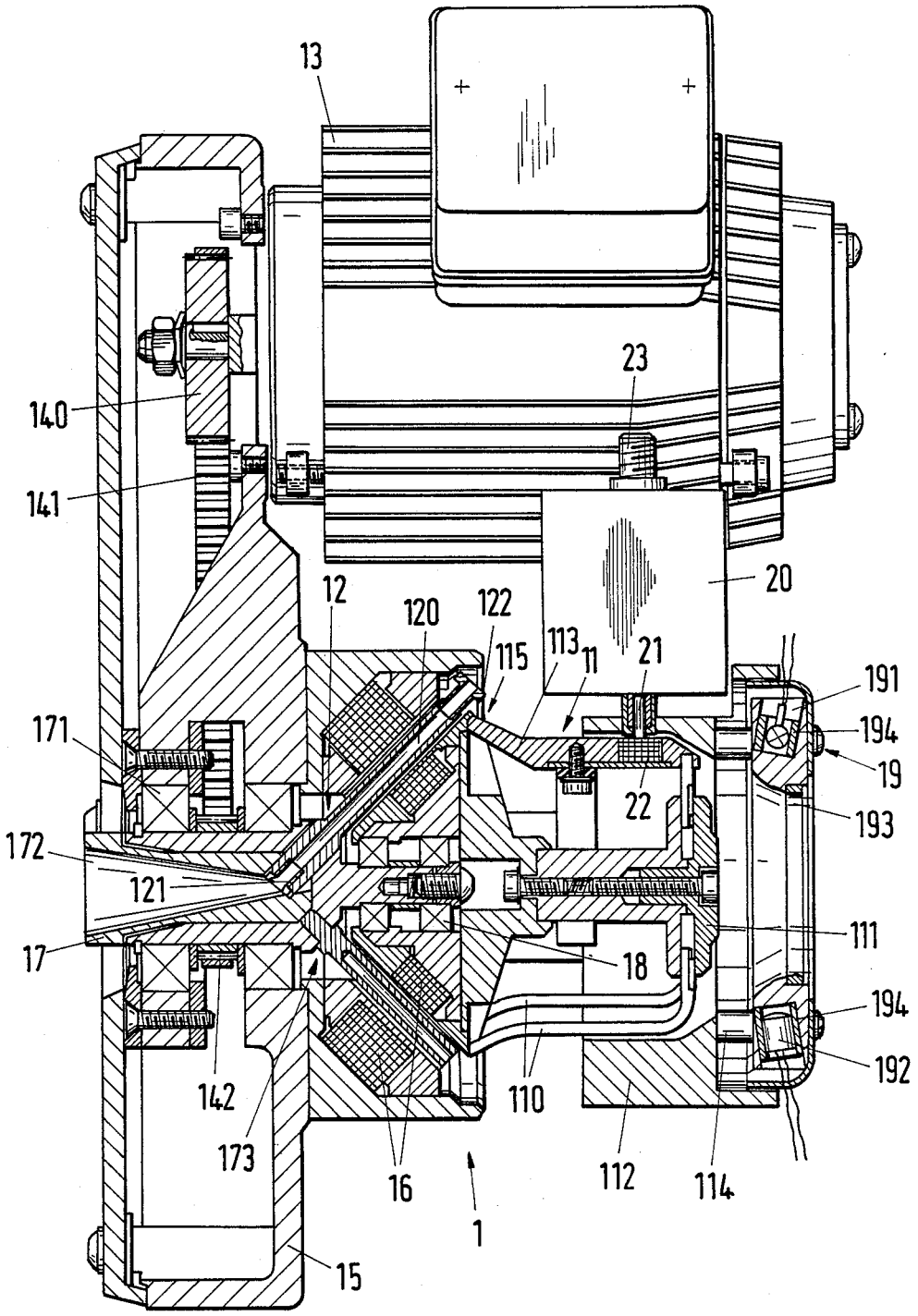
FIG. 2 illustrates a part cross-sectional view of the yarn store of FIG. 1.

Referring to FIG. 2, the Weft yarn store 1 includes a funnel 172 within a winder shaft 17 through which the weft yarn enters prior to passage into the winder 12. The winder 12 which is shown schematically in FIG. 1 is formed of a tube 120 having eyes 121, 122 at opposite ends. This tube 120 is secured in the shaft 17 in known manner. In addition, a rod 173 which functions as a counterweight is disposed diametrically opposite the winder tube 120.

The winder shaft 17 is mounted via bearings 171 in a casing 15 and is driven by a controlled electric motor 13 by way of a drive 14, such as a belt drive 140, 141, 142. The drum 11 is mounted via radial bearings 18 on the winder shaft 17 and is prevented from rotating with the shaft 17 by magnet pairs 16. One magnet of each pair is disposed in the casing 15 and the other magnet is disposed in the drum 11

An envelope 113 extends over only some of the periphery of the drum 11 while the remainder of the drum 11 is formed by stirrups 110 having bent ends which converge radially at a flange 111. The flange 111 is, in turn, operative to retain the stirrups 110 and facilitates radial adjustment of the stirrups 110 so that the periphery of the drum can be varied in accordance with the weft yarn length required in the loom 30. After the weft yarn has been deposited on a conical part 115 of the drum 11, the windings of weft yearn slide to the right, as viewed in FIG. 2 onto the cylindrical part of the drum 11 for intermittent withdrawal therefrom.

The construction of the drum is generally conventional and need not be further described.

Referring to FIG. 1, the weft yarn store includes an electromagnetic yarn clamp 20 which cooperates with the drum 11 in order to retain the weft yarn 10 thereon after picking. As indicated, the weft yarn clamp 20 is in the form of an electromagnet which is disposed opposite an abutment surface 22 of the drum 11 for retaining the weft yarn thereat.

Referring to FIG. 2, wherein like reference characters indicate like parts as above, the electromagnet 20 has a locking pin 21 which is reciprocably mounted to engage against the abutment surface 22 of the drum 11.

The beginning and termination of drawing-off of the yarn are controlled by the locking pin 21 which the electromagnet 20 can move radially onto the abutment surface 22 in the drum 11. As indicated in FIG. 2, the magnet 20 has a connecting boss 23 for compressed air operative to cool and damp the magnet armature.

A cap 112 engages around the draw-off end of the drum 11 and co-operates therewith to bound a narrow annular gap for braking the turns of yarn leaving the store 1.

A monitor device 19, mainly comprising a monitor ring 190 and a pair of sensors mounted in the ring 190, is secured by pins 114 to the cap 112. The ring 190 is made of a transparent material such as Plexiglass, and has a conical internal surface to limit the balloon of departing weft yarn. The exit edge of the ring 190 is protected by a wearing or replacement ring 193 made, for example, of hardened steel or of ceramic.

Referring to FIGS. 3 and 3, the sensors are circumferentially spaced about the ring 190 and about the opening through which the weft yarn is drawn-off the drum 11. Each sensor includes a transmitter 191, 191' which co-operates with a receiver 192, 192' to form a light beam or barrier 195, 195'. Referring to FIG. 4, since the beam path 195, 195' is interrupted at the passage of the beams into the ring interior or out of the ring 190, each transmitter 191 and receiver 192 must be disposed in accordance with the angles of refraction of the beams.

As indicated in FIG. 2, a jacket 194 extends around the transmitters 191, 191' and receivers 192, 192.

The passage of the weft yarn 10 from the drum 11 is sensed by the yarn 10 briefly interrupting the beam paths 195, 195' (see FIG. 3). The receivers 192, 192' then emit signals in response and these signals are transmitted to amplifiers A and B, respectively (see FIG. 4). An evaluating unit W shown in FIG. 4 compares the sequence of the signals in time from the amplifiers A, B with an expected model. FIG. 5*a* shows the expected signal sequence model for the case in which there is a dual arrangement of transmitters 191 and receivers 192. At each revolution of the weft yarn in the ring 190, the beam path 195, 195' is interrupted twice, leading to the formation and propagation of two rectangular pulses in time sequence at the evaluating unit W. If the monitor device is operating correctly, the unit W transmits a control signal to a control for the magnet 20 FIG. 2 when a predetermined number of regular pulses have been recorded in the unit W.

After the required number of turns of yarn have been drawn off the drum 11, the magnet 20 presses the pin 21 onto the abutment surface 22 to terminate the drawing-off of the yarn 10 from the drum 11.

Since the receivers 192, 192' of the monitor device 19 of FIG. 4, produce the monitoring signals alternately, the monitor 19 can detect fault signals and distinguish them from an actual disturbance of yarn movement, for example, because of the weft yarn tearing.

Referring to FIG. 5*b*, an unhatched rectangle represents an interference or disturbing signal for the amplifier A, such signal being caused, for example, by a speck of dirt crossing the beam path 195'. Since the remaining signals expected from the receivers 192, 192' enter in accordance with the program, the evaluating unit W does not, in this case, recognize a disturbance in the passage of the weft yarn 10 and therefore suppresses the disturbing signal.

FIG. 5*c* shows another possible signal processing disturbance The unhatched rectangle shown in chain lines represents the failure of an expected signal to reach the amplifier B. This fault may occur when a thin zone in the weft yarn crosses the beam path 195 and causes an insignificant weakening of the radiation insufficient to be detected as an interruption of the beam. Since the other expected signals correspond to the expected model, it can be reckoned that the weft yarn is being delivered properly by the drum 11. In this case, the evaluating unit W does not report any fault to the yarn store control S.

Finally, FIG. 5*d* shows the signal sequence in the event of a yarn breakage during picking. The effect is that the drawing-off of weft yarn from the drum 11 of the store 1 terminates prematurely. Thereafter, the expected signals corresponding to the non-hatched chain-line rectangles of FIG. 5*d* do not arrive at the evaluating unit W. The unit W then responds by transmitting an alarm signal to the yarn store control S. The alarm signal stops the loom, whose control is coupled with the control S of the yarn store, so that the yarn break can be repaired.

Referring to FIGS. 6 and 7, wherein like reference characters indicate like parts as above, the monitor device may include an annular reflector cone 24 mounted on the drum 11 of the store to reflect the light beam of each transmitter 191, 191' to a receiver 192, 192', respectively disposed immediately adjacent the transmitter. In this device, only one signal at a time is received alternately in the amplifiers A and B (not shown), as indicated in FIG. 8*a*, during the drawing-off of weft yarn from the drum 11. In this case too, the evaluation unit W (not shown) can detect and suppress a misrecorded signal corresponding to an unhatched rectangle in FIG. 8*b* and caused, for example, by fluff. An absent expected signal corresponding to the unhatched rectangle shown in chain lines in FIG. 8*c* does not cause a fault report-back to the yarn control S by the evaluating unit W since the following expected signals arrive.

The case of a yarn breakage is shown in FIG. 8*d* and is indicated by a number of expected but non-arriving signals and leads to immediate stoppage of the loom and of the weft yarn store by way of the control S.

FIG. 1 illustrates the control of the electric motor 13 for the weft yarn winder 12. The function of the motor 13 is so to drive the winder 12 by way of a belt drive 14 so that the number of windings of yarn drawn off the drum 11 are immediately replaced by fresh yarn being wound on from the package 100 to ensure that yarn windings are always present on the drum 11 in sufficient quantity. The number of yarn turns actually drawn off is continuously reported by the evaluating unit W to a comparator V which, by way of a sensor 125 and a report-back from the control SE for the electric motor 13, records the number of freshly deposited yarn windings. The difference between freshly deposited yarn windings and drawn-off yarn windings is transmitted by the comparator V to a controller R which compares the difference from the comparator V with the set value of an input device SW and delivers control instructions accordingly to the electric motor control SE.

The invention thus provides a monitor device of simple and reliable construction which is able to operate without reacting to spurious signals, for example, caused by dust, fluff and/or dirt.

The invention further provides a monitoring procedure whereby malfunctioning of a loom due to excessive or insufficient lengths of picked weft yarns is reduced and the operating life of a loom extended.

What is claimed is:

1. A monitor device for a weft yarn store comprising at least two sensors mounted in circumferentially spaced relation about an opening of a yarn store, each said sensor being operable to emit a signal in response to transverse passage of a weft yarn thereby;

an evaluating unit connected to each sensor to receive and evaluate a sequence of signals from each sensor and to emit a control signal in response to said sequence of signals conforming to a predetermined sequence of signals; and a yarn store control connected to said evaluating unit to receive said control signal for controlling a weft yarn store in response thereto.

2. A monitor device as set forth in claim 1 wherein each sensor includes a transmitter for emitting a beam across a weft yarn path and a receiver for receiving the beam to emit a signal in response to a weft yarn interrupting said beam.

3. A monitor device as set forth in claim 2 wherein said transmitter and said receiver are diametrically disposed.

4. A monitor device as set forth in claim 2 which further comprises an annular reflector cone radially within said sensors for reflecting a beam of a respective transmitter to a respective receiver.

5. A monitor device as set forth in claim 1 which further comprises a ring mounting said sensors therein.

6. In combination, a weft yarn store including a stationary drum for receiving a plurality of weft yarn windings thereon and a cap about one end of said drum to guide the weft yarn through a central opening in said cap; and a monitor device including at least two sensors about said opening, each sensor being operable to emit a signal in response to transverse passage of a weft yarn thereby, an evaluating unit connected to each sensor to receive and evaluate a sequence of signals from each sensor and to emit a control signal in response to said sequence of signals conforming to a predetermined sequence of signals; and a yarn store control connected to said evaluating unit to receive said control signal for controlling said weft yarn store in response thereto.

7. The combination as set forth in claim 6 which further comprises a ring secured to said cap and mounting said sensors thereon.

8. The combination as set forth in claim 6 wherein each sensor includes a transmitter for emitting a beam across a weft yarn path and a receiver for receiving the beam to emit a signal in response to a weft yarn interrupting said beam.

9. The combination as set forth in claim 6 which further comprises an annular reflector cone radially within said sensors for reflecting a beam of a respective transmitter to a respective receiver.

10. A method of operating a weft yarn store for a loom comprising the steps of winding a weft yarn onto a drum of a yarn store into a plurality of windings;

taking off the weft yarn from one end of the drum in an axial direction;

sensing the passage of the weft yarn past at least two circumferentially spaced points at the end of the drum and emitting a signal in response to passage of the weft yarn past a respective point;

evaluating a sequence of signals corresponding to each point and emitting a control signal in response to the sequences of signals conforming to a predetermined sequence of signals; and controlling the weft yarn store in response to said control signal.

11. A method as set forth in claim 10 wherein the absence of a single expected signal from one of said points and an absence of a corresponding signal at a second point causes emission of a control signal.

12. A method as set forth in claim 10 Wherein generation of an unexpected signal from one of said points is not evaluated if occurring only once in said sequence of signals therefrom and a corresponding signal is not generated from the other point.

* * * * *

UNITED STATES PATENT AND TRADEMARK OFFICE

CERTIFICATE OF CORRECTION

PATENT NO. : 4,848,417

DATED : July 18, 1989

INVENTOR(S) : MARTINUS DEKKER, et al

It is certified that error appears in the above-identified patent and that said Letters Patent is hereby corrected as shown below:

Column 1, line 47 "Weft" should be -weft-
Column 1, line 57 cancel "is"
Column 3, line 52 "192, 192" should be -192, 192'-
Column 3, line 68 "control" should be -control SS-
Column 6, line 49 "Wherein" should be -wherein-

Signed and Sealed this

Twenty-ninth Day of January, 1991

*Attest:*

HARRY F. MANBECK, JR.

*Attesting Officer*

*Commissioner of Patents and Trademarks*